US009147531B2

(12) United States Patent
Maloney et al.

(10) Patent No.: US 9,147,531 B2
(45) Date of Patent: Sep. 29, 2015

(54) ELECTRICAL SWITCHING APPARATUS AND MOVABLE CONTACT ARM ASSEMBLY THEREFOR

(71) Applicant: EATON CORPORATION, Cleveland, OH (US)

(72) Inventors: James G. Maloney, Industry, PA (US); Roger W. Helms, Beaver Falls, PA (US)

(73) Assignee: EATON CORPORATION, Cleveland, OH (US)

( * ) Notice: Subject to any disclaimer, the term of this patent is extended or adjusted under 35 U.S.C. 154(b) by 435 days.

(21) Appl. No.: 13/692,053

(22) Filed: Dec. 3, 2012

(65) Prior Publication Data

US 2014/0151206 A1 Jun. 5, 2014

(51) Int. Cl.

| | |
|---|---|
| ***H01H 3/02*** | (2006.01) |
| ***H01H 1/02*** | (2006.01) |
| ***H01H 1/22*** | (2006.01) |

(52) U.S. Cl.

CPC . *H01H 3/02* (2013.01); *H01H 1/02* (2013.01); *H01H 1/22* (2013.01)

(58) Field of Classification Search

CPC ..... H01H 1/02; H01H 3/02; H01H 1/22
USPC ..... 337/3, 13, 14, 36, 109; 200/329
See application file for complete search history.

(56) References Cited

U.S. PATENT DOCUMENTS

| | | | | |
|---|---|---|---|---|
| 2,925,481 | A * | 2/1960 | Casey | 335/23 |
| 3,046,371 | A * | 7/1962 | Jencks | 335/21 |
| 3,440,579 | A * | 4/1969 | Smith | 335/18 |
| 3,564,184 | A | 2/1971 | Gauthier et al. | |
| 3,941,299 | A | 3/1976 | Godfrey | |
| 5,224,884 | A * | 7/1993 | Singer et al. | 439/819 |
| 5,910,758 | A | 6/1999 | Maloney et al. | |
| 6,010,059 | A * | 1/2000 | Newland | 228/110.1 |
| 6,249,197 | B1 * | 6/2001 | Zindler et al. | 335/202 |
| 6,252,480 | B1 * | 6/2001 | Kramer | 335/172 |
| 6,259,048 | B1 * | 7/2001 | Castonguay et al. | 200/244 |
| 7,148,774 | B1 | 12/2006 | Shea et al. | |
| 7,217,895 | B1 | 5/2007 | Shea et al. | |
| 7,812,276 | B2 | 10/2010 | Maloney et al. | |

(Continued)

FOREIGN PATENT DOCUMENTS

| | | | |
|---|---|---|---|
| DE | 20 02 934 | A1 | 7/1970 |
| DE | 10 2007 040171 | A1 | 2/2009 |

OTHER PUBLICATIONS

European Patent Office, "International Search Report and Written Opinion", Jan. 29, 2014, 9 pp.

*Primary Examiner* — Anatoly Vortman
(74) *Attorney, Agent, or Firm* — Eckert Seamans Cherin & Mellott, LLC; Grant E. Coffield

(57) ABSTRACT

A movable contact arm assembly is provided for an electrical switching apparatus, such as a circuit breaker. The movable contact arm assembly includes a first member, and a second member attached to the first member. The first member is made from a first material, such as steel, and the second member is made from a second different material, such as copper. The first and second members each include first and second ends. The first end of the first member cooperates with the operating mechanism of the circuit breaker. The first end of the second member is attached to the second end of the first member. A movable contact is disposed on the second end of the second member.

18 Claims, 5 Drawing Sheets

(56) References Cited

U.S. PATENT DOCUMENTS 7,830,232 B2 * 11/2010 Grahor et al. ..... 335/201
8,004,376 B2 8/2011 Maloney et al.
2011/0132875 A1 6/2011 Werner et al.

* cited by examiner

ELECTRICAL SWITCHING APPARATUS AND MOVABLE CONTACT ARM ASSEMBLY THEREFOR

CROSS-REFERENCE TO RELATED APPLICATION

This application is related to commonly assigned, copending U.S. patent application Ser. No. 13/692,296, filed Dec. 5, 2012, entitled "ELECTRICAL SWITCHING APPARATUS AND CONDUCTOR ASSEMBLY THEREFOR".

BACKGROUND

1. Field

The disclosed concept relates generally to electrical switching apparatus and, more particularly, to electrical switching apparatus, such as circuit breakers. The disclosed concept also relates to movable contact arm assemblies for electrical switching apparatus.

2. Background Information

Electrical switching apparatus, such as circuit breakers, provide protection for electrical systems from electrical fault conditions such as, for example, current overloads, short circuits, abnormal voltage and other fault conditions.

Typically, circuit breakers include an operating mechanism, which opens electrical contact assemblies to interrupt the flow of current through the conductors of an electrical system in response to such fault conditions. The electrical contact assemblies include stationary electrical contacts and corresponding movable electrical contacts that are typically mounted on movable (e.g., pivotable) arms. The stationary and movable contacts are in physical and electrical contact with one another when it is desired that the circuit breaker provide electrical current therethrough to a load. When it is desired to interrupt the power circuit, the movable contact arm is pivoted, thereby moving the movable contact away from the stationary contact creating a space therebetween.

The movable contact arms of some circuit breakers are unitary members made from one single piece of material and including a first end, which cooperates with the circuit breaker operating mechanism (e.g., without limitation, operating handle), and a second end where the movable contact is disposed. Typically, the movable contact arms and movable contacts are made from copper. Thus, as the cost of copper increases, the cost of the movable contact arm assembly correspondingly increases.

There is, therefore, room for improvement in electrical switching apparatus, such as circuit breakers, and in movable contact arm assemblies therefor.

SUMMARY

These needs and others are met by embodiments of the disclosed concept, which are directed to a movable contact arm assembly, which among other benefits, employs a plurality of members made from different materials to reduce the amount of copper required.

As one aspect of the disclosed concept, a movable contact arm assembly is provided for an electrical switching apparatus. The electrical switching apparatus includes a housing, separable contacts enclosed by the housing, and an operating mechanism for opening and closing the separable contacts. The movable contact arm assembly comprises: a first member; and a second member attached to the first member. The first member is made from a first material and the second member is made from a second different material.

The first member and the second member may combine to form a bimetallic movable contact arm. The first material of the first member may be steel, and the second material of the second member may be copper.

The first member and the second member may each include a first end and a second end. The first end of the first member may be structured to cooperate with the operating mechanism, the first end of the second member may be attached to the second end of the first member, and a movable contact may be structured to be disposed on the second end of the second member. The second end of the first member may have a first shape, the first end of the second member may have a second shape, and the first shape of the first member may compliment the second shape of the second member. The second end of the first member may comprise a recess, and the first end of the second member may comprise a protrusion, wherein the protrusion is disposed within the recess.

An electrical switching apparatus comprising at least one of the aforementioned movable contact assemblies, is also disclosed.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

Figure 1:
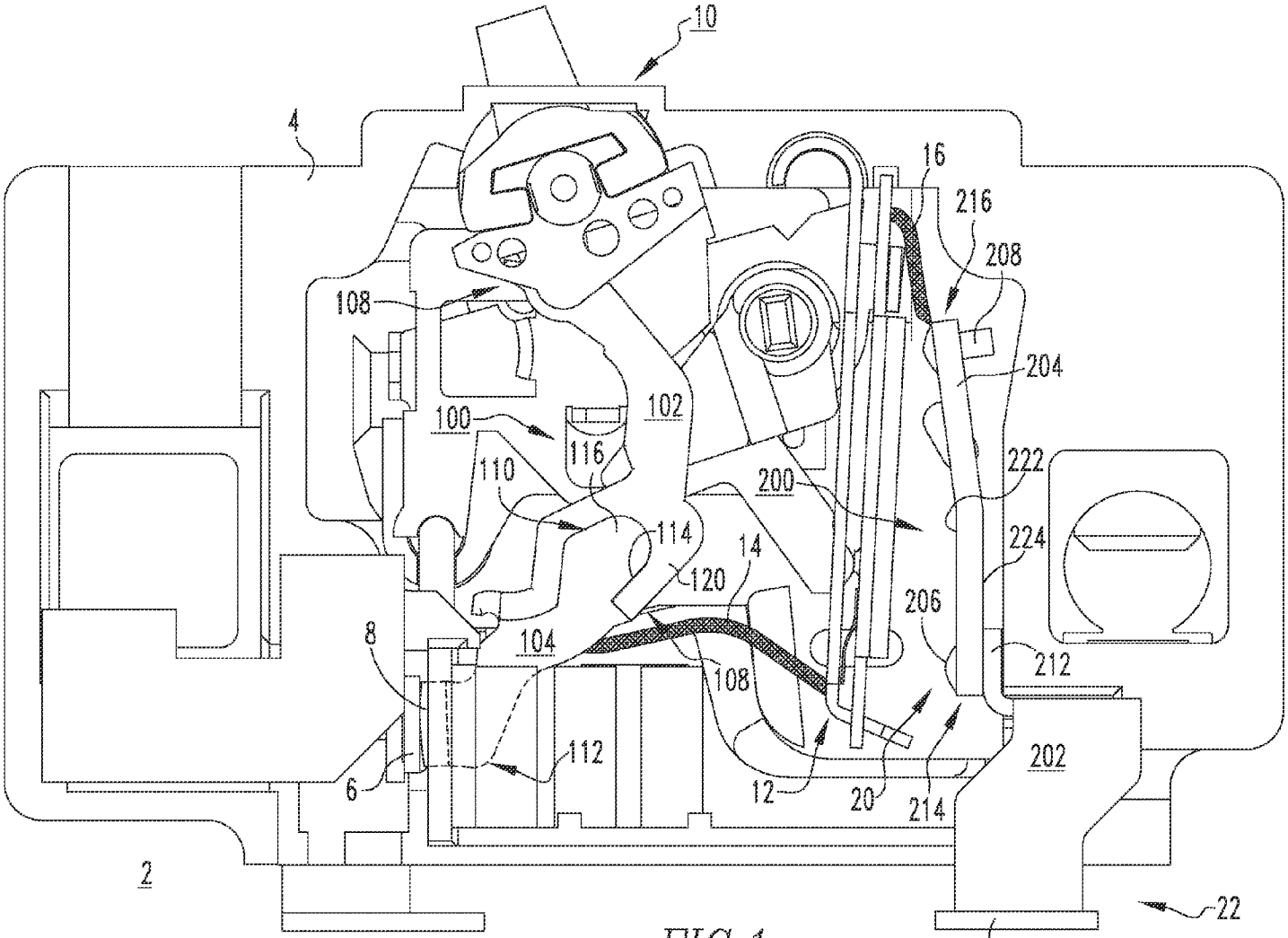
FIG. 1 is a side elevation view of a circuit breaker and movable contact arm assembly therefor, in accordance with an embodiment of the disclosed concept, showing the circuit breaker in the ON position.

Directional phrases used herein, such as, for example, left, right, front, back, top, bottom and derivatives thereof, relate to the orientation of the elements shown in the drawings and are not limiting upon the claims unless expressly recited therein.

As employed herein, the term "fastener" refers to any suitable connecting or tightening mechanism expressly including, but not limited to rivets, screws, bolts and the combinations of bolts and nuts (e.g., without limitation, lock nuts) and bolts, washers and nuts.

As employed herein, the statement that two or more parts are "coupled" together shall mean that the parts are joined together either directly or joined through one or more intermediate parts.

As employed herein, the statement that two or more parts are "attached" shall mean that the parts are directly joined together, without any intermediate parts.

As employed herein, the term "number" shall mean one or an integer greater than one (i.e., a plurality).

FIG. 1 shows a movable contact assembly 100 for an electrical switching apparatus, such as for example and without limitation, a circuit breaker 2, in accordance with one non-limiting embodiment of the disclosed concept. The circuit breaker 2 includes a housing 4, separable contacts 6,8 enclosed by housing 4, and an operating mechanism, such as for example and without limitation an operating handle 10, for opening and closing the separable contacts 6,8.

In FIG. 1, the separable contacts 6,8 include a stationary contact 6 and a movable contact 8 (partially shown in hidden line drawing in FIG. 1), and are shown in electrical contact with one another, corresponding to the circuit breaker 2 being disposed in the ON position.

Figure 2:
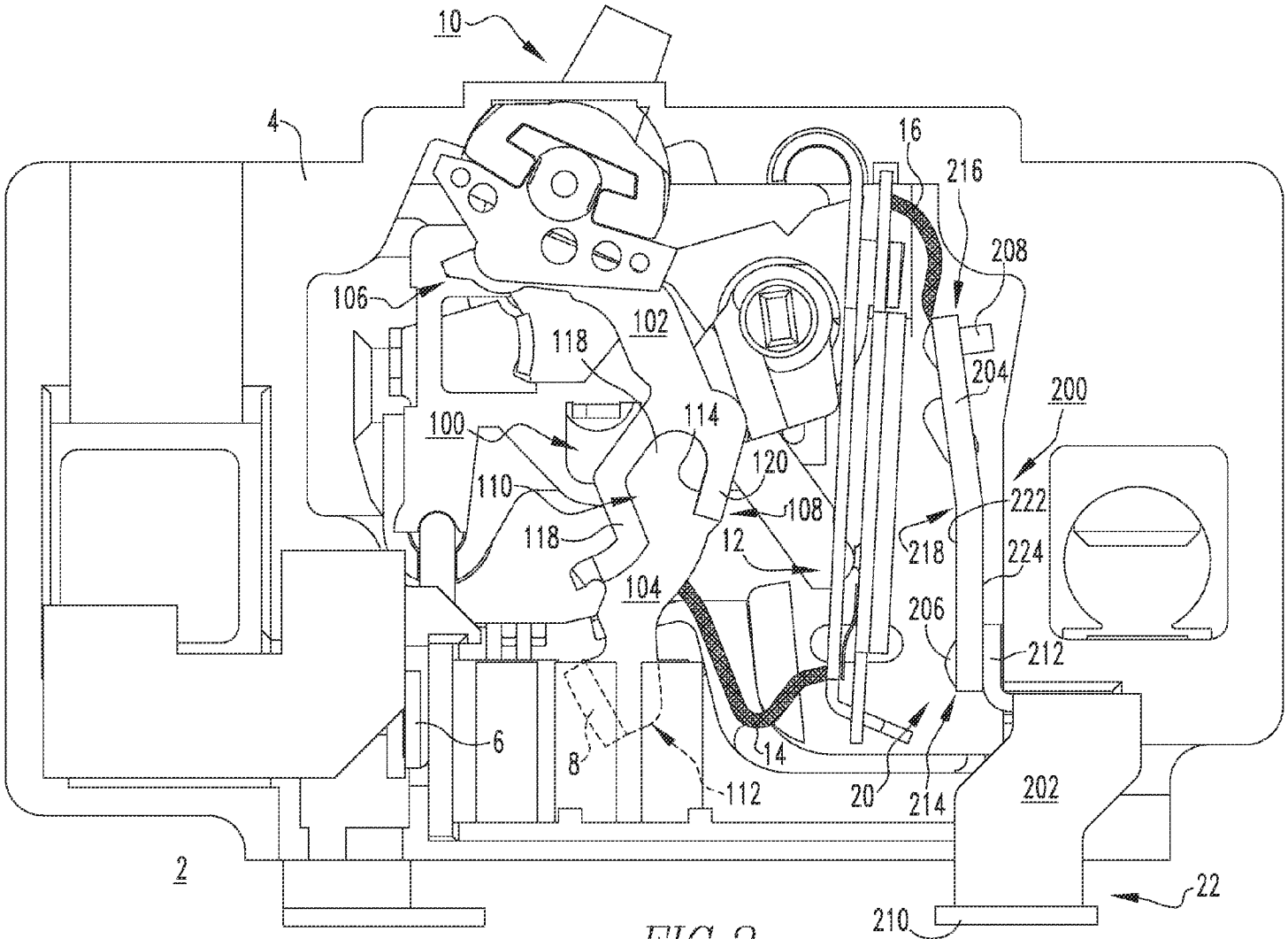
FIG. 2 is an isometric view of the circuit breaker and movable contact arm assembly of FIG. 1, showing the circuit breaker in the OFF position.
Figure 3:
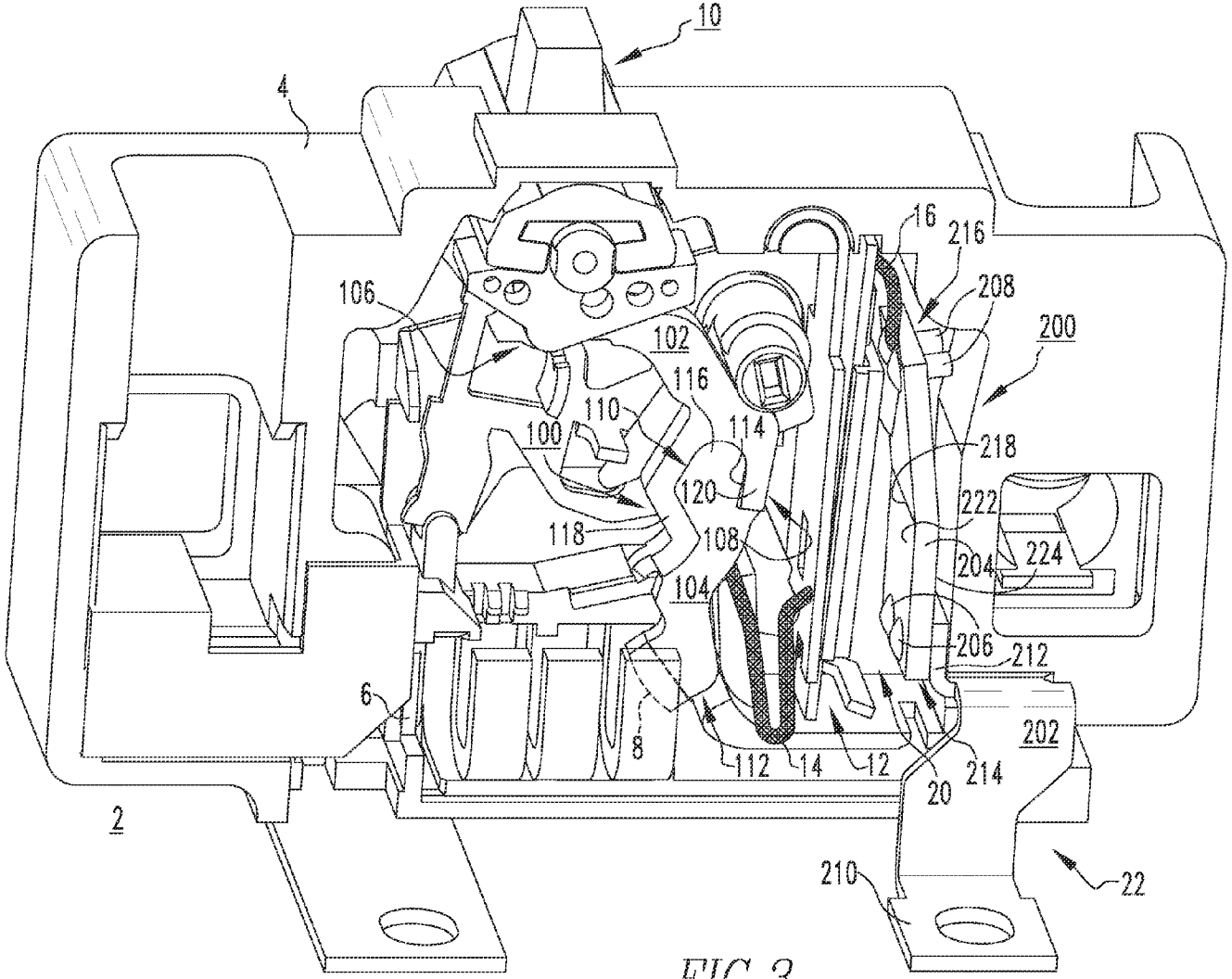
FIG. 3 is a side elevation view of the circuit breaker and movable contact arm assembly of FIG. 2, showing the circuit breaker in the TRIPPED position.

FIG. 2 shows the operating handle 10, separable contacts 6,8, and other circuit breaker components in their respective positions corresponding to the circuit breaker 2 being disposed in the OFF position, such that the movable contact 8 (shown in hidden line drawing in FIG. 2) is separated, and electrically disconnected, from the stationary contact 6, as shown. FIG. 3 shows the circuit breaker 2 and corresponding components (e.g., without limitation, separable contacts 6,8; operating mechanism 10; movable contact arm assembly 100) in their respective positions corresponding to the circuit breaker 2 being disposed in the TRIPPED position.

It will be appreciated that while the example non-limiting embodiment shown and described herein includes a single movable contact arm assembly 100 and a single pair of separable contacts 6,8, any known or suitable alternative number and/or configuration of movable contact arms (e.g., 100) and corresponding sets of separable contacts (e.g., 6,8) could be employed, without departing from the scope of the disclosed concept.

Figure 4B:
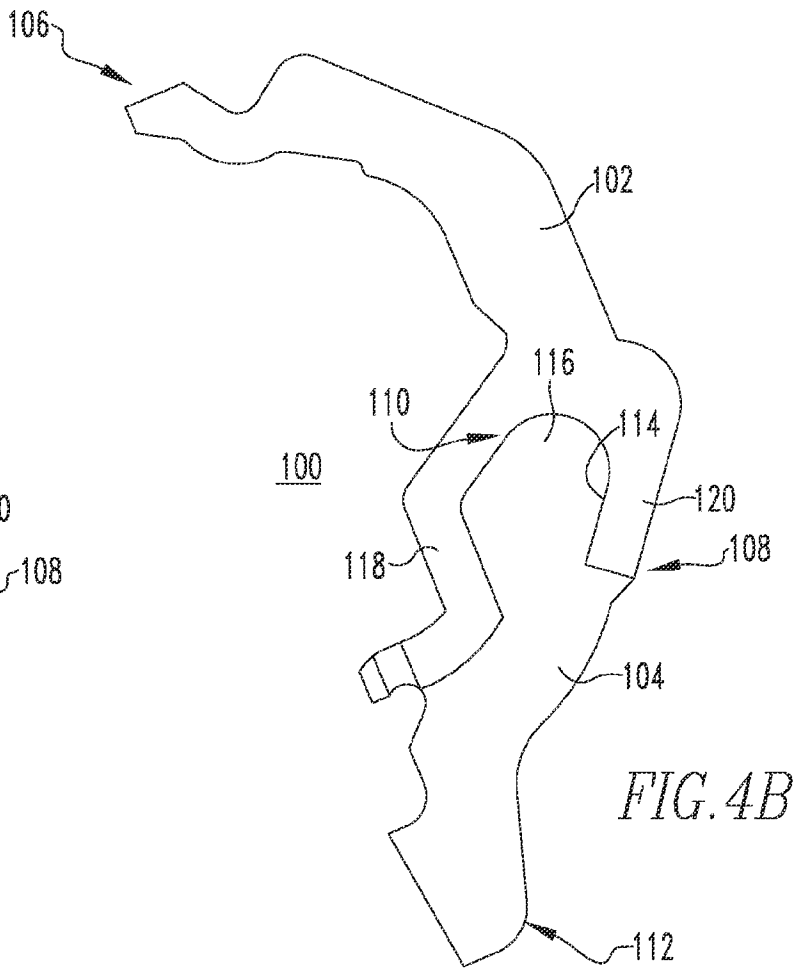
FIG. 4B is an assembled side elevation view of the movable contact arm assembly of FIG. 4A.

Continuing to refer to FIGS. 1-3, and also to FIGS. 4A and 4B, the example movable contact arm assembly 100 includes a first member 102 and a separate second member 104, which is attached to the first member 102, as will be described in greater detail hereinbelow. Specifically, the first member 102 is made from a first material and the second member 104 is made from a second, different material.

In one non-limiting embodiment, in accordance with the disclosed concept, the first member 102 and the second member 104 combined to form a bimetallic movable contact arm 100. The term "bimetallic" as used herein refers to an assembly of a plurality (e.g., at least two) of metal parts attached or otherwise suitably joined together (see, for example and without limitation, bimetallic movable contact arm 100, best shown in FIG. 4B). For example and without limitation, preferably the first material of the first member 102 is steel, and the second material of the second member 104 is copper. In this manner, the amount of copper required for the movable contact arm assembly 100 is reduced. In other words, in accordance with the disclosed concept, rather than a single unitary piece of copper being used for the entire movable contact arm, in accordance with conventional designs, a substantial reduction in the amount of copper used is achieved by replacing copper with steel or another suitable material in the non-conducting portion of the movable contact arm assembly 100.

As shown in FIGS. 1-3, the aforementioned movable contact 8 (shown in hidden line drawing in FIGS. 2 and 3) is disposed on the second member 104. Specifically, the first and second members 102,104 each include first ends 106,110 and second ends 108,112, respectively. The first end 106 of first member 102 cooperates with the operating mechanism 10 (e.g., without limitation, opening handle). The first end 110 of the second member 104 is attached to the second end 108 of the first member 102. The movable contact 8 is disposed on the second end 112 of the second member 104, as shown. It will be appreciated, however, that the movable contact 8 could alternatively comprise an integral portion or segment of the second member 104. In other words, it is not a requirement of the disclosed concept for the separable contact 8 to be a separate part that is attached to the second member 104. It is anticipated that it could alternatively comprise an integral portion or segment of the second member 104.

Referring again to FIGS. 4A and 4B, the second end 108 of the first member 102 has a first shape, and the first end 110 of the second member 104 has a second shape. The first shape of the first member 110 compliments the second shape of the second member 104, as shown. Specifically, as used herein, the term "compliments" refers to two opposing shapes, surfaces or configurations of two separate parts that are structured to be attached together such that the opposing surfaces abut and correspond to one another so as to provide a precise interface between the two parts. This relationship will be appreciated, for example and without limitation, with reference to the non-limiting embodiment shown and described with respect to FIGS. 4A and 4B. In the example shown and described, the second end 108 of the first member 102 includes a recess 114, and the first end 110 of the second member 104 includes a protrusion 116. As shown in FIG. 4B the protrusion 116 is disposed within the recess 114 to complete the movable contact arm assembly 100.

Figure 4A:
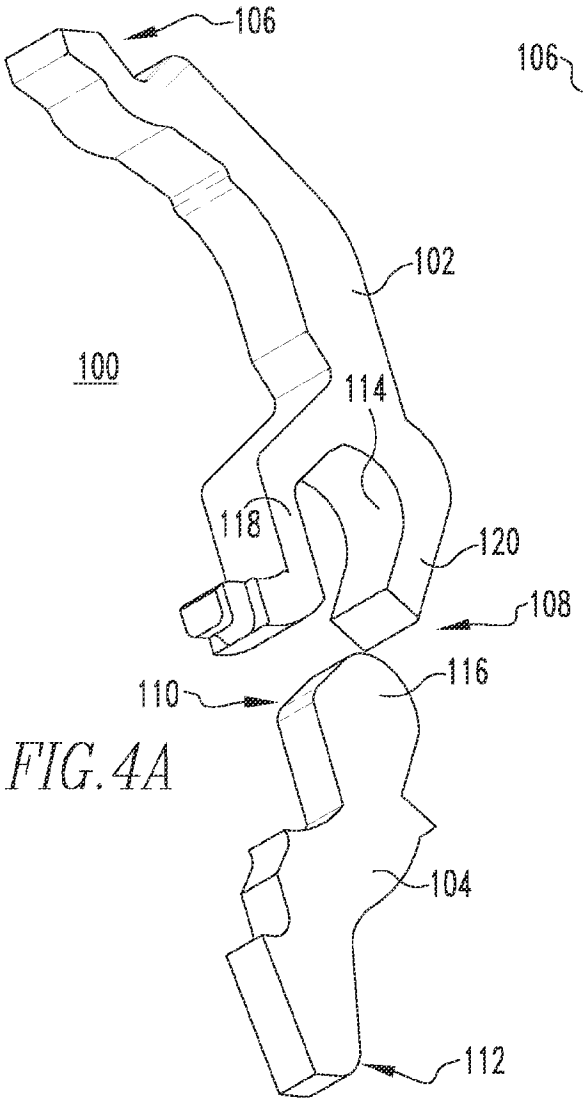
FIG. 4A is an exploded isometric view of the movable contact arm assembly of FIG. 3.

More specifically, the second end 108 of the example first member 102 preferably includes first and second opposing legs 118,120, wherein the recess 114 is formed between such legs 118,120, as best shown in FIG. 4A. Accordingly, the protrusion 116 is disposed within the recess 114 between the first and second legs 118,120 to complete the assembly 100, as shown in FIG. 4B. Preferably, the first and second legs 118,120, which are made, for example and without limitation from steel, are compressed inwardly against the protrusion 116, which is made, for example and without limitation from copper, in order to further secure the copper second member 104 to the steel first member 102.

Referring again to FIGS. 1-3, the example circuit breaker 2 further includes a bimetal structure 12 and a flexible shunt 14. The flexible shunt 14 preferably extends between and electrically connects the second member 104 of the movable contact arm assembly 100 to the bimetal structure 12, as shown. It will, however, be appreciated that any known or suitable alternative type and/or configuration of electrical connection (not shown) could be employed, without departing from the scope of the disclosed concept.

In addition to the aforementioned movable contact arm assembly 100, the example circuit breaker 2 includes a conductor assembly 200 (FIGS. 1-3, 5A, 5B and 5C), which also functions to advantageously further reduce the amount of copper required to be used in the circuit breaker 2.

Figure 5A:
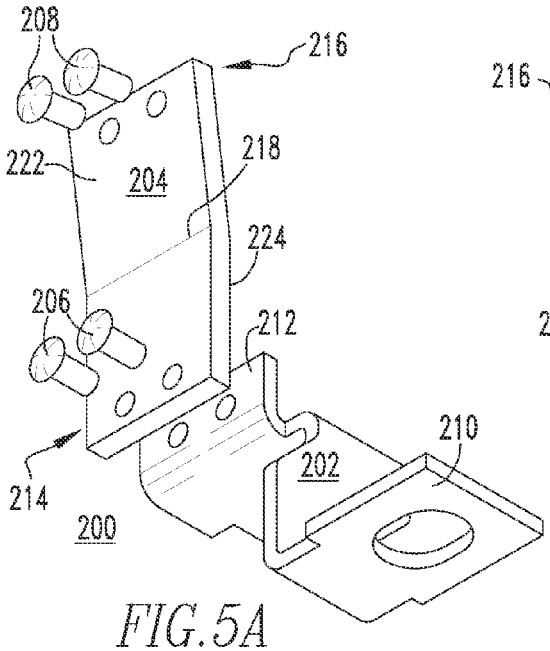
FIG. 5A is an exploded isometric view of an internal conductor assembly.
Figure 5B:
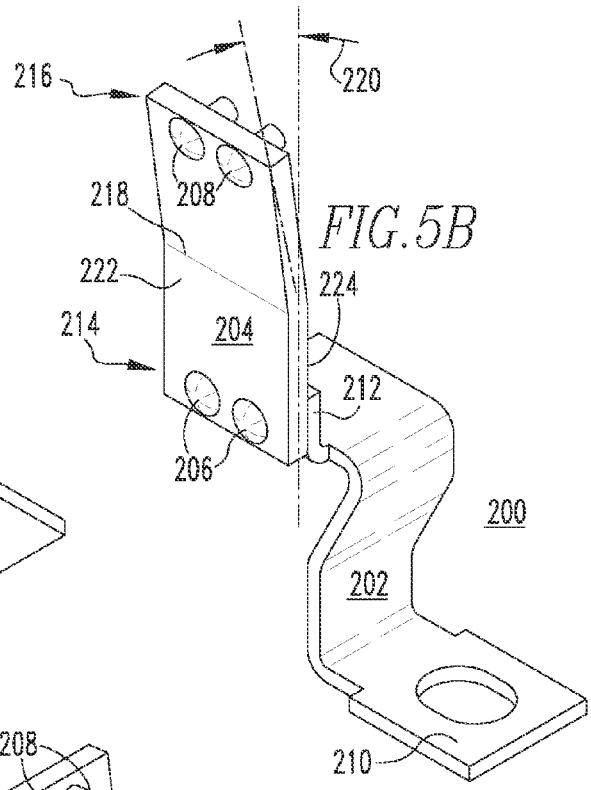
FIGS. 5B and 5C are assembled front and back isometric views of the internal conductor assembly of FIG. 5A.
Figure 5C:
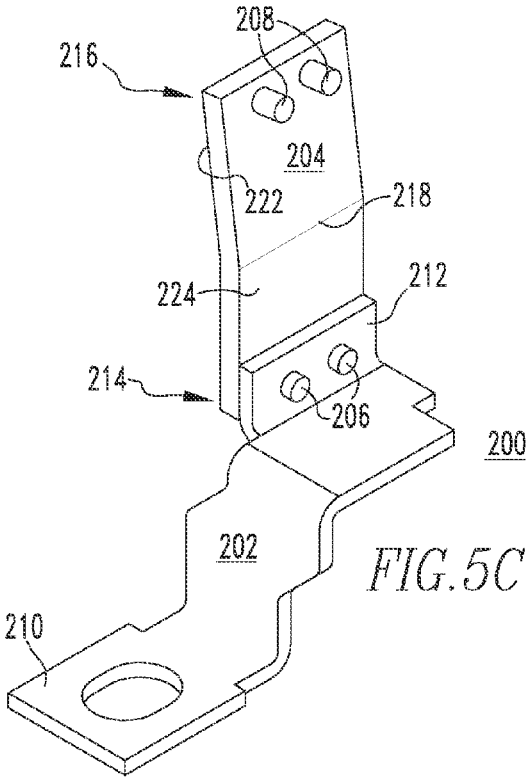

As best shown in FIGS. 5A-5C, the disclosed conductor assembly 200 includes a first conductor member 202, a second conductor member 204, and a plurality of fasteners 206, 208 for mechanically fastening and electrically connecting the first conductor member 202 to the second conductor 204. The first conductor member 202 is made from a first material, such as for example and without limitation, copper, and the second conductor member 204 is made from a second, different material, such as for example and without limitation, aluminum. Accordingly, the first and second conductor members 202,204 combine to form a bimetallic conductor assembly 200, which substantially reduces the amount of copper required.

As shown in FIGS. 1-3, the first conductor member 202 is structured to extend from the exterior 22 of the circuit breaker housing 4 into the interior 20. The fasteners, which in the example shown and described herein are rivets 206, fasten (e.g., rivet) the second conductor member 204 to the first conductor member 202 within the interior 20 of the housing 4. More specifically, the first conductor member 202 includes a terminal portion 210, which is accessible from the exterior 22 of the circuit breaker housing 4, and a mounting portion 212. The example mounting portion 212 is an upturned flange (best shown in FIGS. 5A and 5C), wherein the second conductor member 204 includes opposing first and second ends 214,216, and a first pair 206 of the aforementioned rivets 206,208 fastens the first end 214 of the second conductor member 204 to the upturned flange 212 of the first conductor member 202, within the interior 20 of the circuit breaker housing 4, as shown. In the example shown and described herein, the second conductor member 204 further includes first and second opposing sides 222,224, wherein the second side 224 of the first end 214 of the second conductor member 204 is riveted to the upturned flange 212 using the first pair of rivets 206, as best shown in FIGS. 5A-5C. It will, however, be appreciated that any known or suitable alternative number, type and/or configuration of fastener could be employed, without departing from the scope of the disclosed concept.

Referring to FIGS. 5A-5C, the second conductor member 204 preferably further includes a bend 218 disposed between the first and second ends 214,216. Accordingly, as shown in FIG. 5B, the second end 216 of the second member 204 is disposed at an angle 220 with respect to the first end 214 of the second conductor member 204. As shown in FIGS. 1-3, this configuration of the second end 216 being disposed at an angle 220 (FIG. 5B) with respect to the first end 214, functions to position the second end 216 of the second conductor member 204 of the conductor assembly 200 in the desired orientation with respect to other internal electrically conductive components, such as for example and without limitation, the bimetallic structure 12.

In the example of FIGS. 1-3, the second end 216 of the second conductor member 204 is electrically connected to the bimetal structure 12 by a flexible shunt 16, as shown. The example second conductor member 204 includes a second pair of rivets 208 disposed at or about the second end 216 of the second conductor member 204. In one non-limiting embodiment, the flexible shunt 16 is mechanically fastened and electrically connected to the second end 216 of the second conductor member 204 by a corresponding one of the rivets 208. It will, however, be appreciated that any known or suitable alternative configuration and/or mechanism for electrically connecting the conductor assembly 200 to other circuit breaker components (e.g., without limitation, bimetal structure 12) could be employed, without departing from the scope of the disclosed concept.

It will further be appreciated that the aforementioned conductor assembly 200 could be employed independently within any known or suitable electrical switching apparatus (e.g., without limitation, circuit breaker 2 of FIGS. 1-3) with, or without, the aforementioned movable contact arm assembly 100 (FIGS. 1-4C).

Accordingly, the disclosed concept provides a number of assemblies (e.g., without limitation, movable contact arm assembly 100; conductor assembly 200) that utilize a unique bimetal structure that, among other benefits, serves to reduce the amount of copper required to be used within the circuit breaker 2 (FIGS. 1-3).

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A movable contact arm assembly for an electrical switching apparatus, said electrical switching apparatus including a housing, separable contacts enclosed by the housing, and an operating mechanism for opening and closing said separable contacts, said operating mechanism including an opening handle, said movable contact arm assembly comprising:

a first member; and a second member attached to said first member, wherein said first member is made from a first material and said second member is made from a second different material, wherein said first member and said second member combine to form a bimetallic movable contact arm, said bimetallic movable contact arm including a first end coupled to said opening handle, a second end disposed opposite and distal from the first end, and a junction intermediate the first end and the second end, wherein said first member is disposed between the first end and said junction, and wherein said second member is disposed between said junction and the second end.

2. The movable contact arm assembly of claim 1 wherein the first material of said first member is steel; and wherein the second material of the second member is copper.

3. The movable contact arm assembly of claim 1 wherein said separable contacts comprise a stationary contact and a movable contact; wherein said stationary contact is coupled to the housing of said electrical switching apparatus; and wherein said movable contact is disposed on said second member.

4. The movable contact arm assembly of claim 3 wherein said first member and said second member each include a first end and a second end; wherein the first end of said first member cooperates with said opening handle; wherein the first end of said second member is attached to the second end of said first member at said junction; and wherein said movable contact is disposed on the second end of the second member.

5. The movable contact arm assembly of claim 4 wherein the second end of said first member has a first shape; wherein the first end of said second member has a second shape; and wherein the first shape of said first member compliments the second shape of said second member.

6. The movable contact arm assembly of claim 5 wherein the second end of said first member comprises a recess; wherein the first end of said second member comprises a protrusion; and wherein said protrusion is disposed within said recess.

7. The movable contact arm assembly of claim 6 wherein the second end of said first member further comprises a first leg and a second leg disposed opposite the first leg; wherein said recess is formed between the first leg and the second leg; and wherein said protrusion is disposed within said recess between the first leg and the second leg.

8. The movable contact arm assembly of claim 7 wherein the first leg and the second leg are compressed against said protrusion to secure said second member to said first member.

9. The movable contact arm assembly of claim 1 wherein said electrical switching apparatus further includes a bimetal structure; wherein said second member further includes a flexible shunt; and wherein said flexible shunt electrically connects said second member to said bimetal structure.

10. An electrical switching apparatus comprising:

a housing;

separable contacts enclosed by the housing;

an operating mechanism for opening and closing said separable contacts, said operating mechanism including an operating handle; and at least one movable contact arm assembly comprising:

a first member, and a second member attached to said first member, wherein said first member is made from a first material and said second member is made from a second different material, wherein said first member and said second member combine to form a bimetallic movable contact arm, said bimetallic movable contact arm including a first end coupled to said opening handle, a second end disposed opposite and distal from the first end, and a junction intermediate the first end and the second end, wherein said first member is disposed between the first end and said junction, and wherein said second member is disposed between said junction and the second end.

11. The electrical switching apparatus of claim 10 wherein the first material of said first member is steel; and wherein the second material of the second member is copper.

12. The electrical switching apparatus of claim 10 wherein said separable contacts comprise a stationary contact and a movable contact; wherein said stationary contact is coupled to the housing of said electrical switching apparatus; and wherein said movable contact is disposed on said second member.

13. The electrical switching apparatus of claim 12 wherein said first member and said second member each include a first end and a second end; wherein the first end of said first member cooperates with said opening handle; wherein the first end of said second member is attached to the second end of said first member at said junction; and wherein said movable contact is disposed on the second end of the second member.

14. The electrical switching apparatus of claim 13 wherein the second end of said first member has a first shape; wherein the first end of said second member has a second shape; and wherein the first shape of said first member compliments the second shape of said second member.

15. The electrical switching apparatus of claim 14 wherein the second end of said first member comprises a recess; wherein the first end of said second member comprises a protrusion; and wherein said protrusion is disposed within said recess.

16. The electrical switching apparatus of claim 15 wherein the second end of said first member further comprises a first leg and a second leg disposed opposite the first leg; wherein said recess is formed between the first leg and the second leg; and wherein said protrusion is disposed within said recess between the first leg and the second leg.

17. The electrical switching apparatus of claim 16 wherein the first leg and the second leg are compressed against said protrusion to secure said second member to said first member.

18. The electrical switching apparatus of claim 10 wherein said electrical switching apparatus is a circuit breaker; wherein said circuit breaker further includes a bimetal structure and a flexible shunt; and wherein said flexible shunt electrically connects said second member to said bimetal structure.

* * * * *